US005552189A

United States Patent [19]

Shaffer

[11] Patent Number: 5,552,189

[45] Date of Patent: Sep. 3, 1996

[54] METHOD AND APPARATUS FOR APPLYING A PAINTED DESIGN TO AN ARTICLE OF CLOTHING

[76] Inventor: Jeffrey P. Shaffer, 9504 Coldwater Rd., Fort Wayne, Ind. 46825

[21] Appl. No.: 36,905

[22] Filed: Mar. 25, 1993

[51] Int. Cl.[6] ..... B05D 7/00

[52] U.S. Cl. ..... 427/421; 427/260; 427/288; 401/190

[58] Field of Search ..... 427/421, 260, 427/288; 222/401, 630; 239/340, 346, 359, 375, 530, 525, 573; 401/190

[56] References Cited

U.S. PATENT DOCUMENTS

| | | | |
|---|---|---|---|
| D. 186,735 | 11/1959 | Zapolski | D62/2 |
| D. 187,308 | 2/1960 | Adams | D62/2 |
| 1,899,222 | 2/1933 | Werder | 239/375 |
| 2,546,808 | 3/1951 | Wood et al. | 222/399 |
| 3,756,512 | 9/1973 | Dyal | 239/337 |
| 4,154,271 | 5/1979 | Saeki | 141/20 |
| 4,350,299 | 9/1982 | Stephenson | 239/337 |
| 4,453,650 | 6/1984 | Witte et al. | 222/43 |
| 4,742,963 | 5/1988 | Marvaldi | 239/337 |
| 5,147,681 | 9/1992 | Maroney | 427/260 |

OTHER PUBLICATIONS

Brochure for the Badger Air–Brush Gravity Feed Series no date.

Brochure for the Paasche Airbrush Lessons for Beginners no date.

Advertising brochure—Paasche–The New Innovation VSR90#1 no date.

*Primary Examiner*—Shrive Beck
*Assistant Examiner*—David M. Maiorana
*Attorney, Agent, or Firm*—Baker & Daniels

[57] ABSTRACT

A device and process for applying decorative paint to an article of clothing such as a T-shirt or sweatshirt. The device comprises a valve/nozzle assembly and a plurality of disposable, single-use cartridges of pressurized paint. The valve/nozzle assembly includes a threaded fitting having a piercing member extending therefrom that pierces a cover on a selected cartridge as the cartridge is threaded over the fitting. Upon piercing the cover, paint is forced upwardly into a valved passageway within the valve/nozzle assembly. A hinged lever is operatively coupled to the valve such that as the lever is depressed, a spray of paint is released through the nozzle at the end of the valve/nozzle assembly and onto the garment. Thereafter, the cartridge is removed and a second cartridge of paint thinner is attached to the valve/nozzle assembly. Again, the lever is depressed to release a spray of paint thinner through the valve/nozzle assembly for cleansing same. The valve/nozzle assembly is then attached to a second paint cartridge for applying a second color of paint onto the garment.

3 Claims, 2 Drawing Sheets

METHOD AND APPARATUS FOR APPLYING A PAINTED DESIGN TO AN ARTICLE OF CLOTHING

BACKGROUND OF THE INVENTION

The present invention relates generally to devices for applying decorative paint to articles of clothing, and more particularly to an airbrush type device.

Airbrushes are well known and are used in a wide variety of applications, such as art, hobbies, crafts, ceramics, cake decorating, taxidermy, etc. Airbrushes are particularly useful for applying detailed painted designs to T-shirts and sweatshirts. In general, airbrushes can accommodate water based paints, inks, dyes, oils, stains, lacquers, enamels, and acrylics.

A typical airbrush comprises a handle attached to a shell to which is secured a small cup or container filled with paint. The cup may be located above the shell for a gravity feed, or below or alongside the shell for a siphon feed. The bottom of the shell includes a fitting to which an air hose is attached. The opposite end of the hose is attached to a source of pressurized air, such as a $CO_2$ tank, compressor, or aerosol propellant can. The air and liquid paint are brought together and atomized into a spray, either inside or outside the head of the airbrush.

A finger trigger is disposed at the top of the shell of the airbrush and, when depressed, releases a preset amount of spray. Some airbrushes are dual action, wherein depressing the trigger releases air and pulling back on the trigger releases a volume of liquid paint.

Airbrushes are advantageous in that a fine spray of paint may be controlled in order to decorate an object with very intimate designs. However, airbrushes are generally complicated to operate and therefore are primarily intended for professional artists. In addition, the cost of airbrush kits are relatively expensive and impractical for the amateur designer.

In lieu of airbrushes, T-shirts and sweatshirts can be decorated by use of a silkscreen process in which coloring matter is forced onto the material to be printed through the meshes of a screen that is designed to have pervious printing areas and impervious printing areas. However, silkscreening is also a relatively expensive process that is intended for use by professionals in mass-producing a garment having the same design.

It is desired to provide a device and process, whereby an individual may custom paint his/her own garments with the precision obtainable by conventional airbrushes.

SUMMARY OF THE INVENTION

The present invention provides, in one form thereof, a method and apparatus for applying decorative paint to an article of clothing, wherein a pressurized cartridge of paint is attached to a valve/nozzle assembly thereby causing a piercing member to pierce through the cartridge so that pressurized paint flows into a valved passageway within the valve/nozzle assembly. A hinged lever is operatively coupled to a valve in the passageway such that as the lever is depressed, the valve is opened, thereby releasing the pressurized paint out through a nozzle and onto a garment with the accuracy and control of a conventional airbrush.

The invention further provides, in one form thereof a painting kit for custom decorating a garment such as a T-shirt or sweatshirt in a variety of colors and designs. The kit comprises a valve/nozzle assembly and a plurality of pressurized paint cartridges that are each removably threadable onto a fitting at the bottom of the assembly. At least one of the cartridges contains paint thinner for cleaning the interior of the assembly before changing paint colors.

An advantage of the present invention is that a purchaser of a garment may apply a uniquely painted design thereon.

Another advantage of the present invention is that a garment, such as a T-shirt or sweatshirt can be custom painted with professional quality by a person having no prior skills with a conventional airbrush.

Another advantage of the present invention is that the paint cartridges are pressurized, thereby eliminating the necessity of a separate source of pressurized air and an air hose.

Yet another advantage of the present invention is that the paint kit is significantly lower in cost than conventional airbrushes.

Still another advantage of the present invention is that the paint cartridges are easily and conveniently attachable and removable from the valve/nozzle assembly, thereby permitting a user to quickly paint a garment a variety of different colors.

Other advantages of the present invention will become apparent from the detailed description to follow.

The present invention provides, in one form thereof, a method of painting a design onto an article of clothing. The method includes the step of securing a first container of pressurized paint directly to a valve/nozzle assembly, thereby causing the paint to flow into the interior of the valve/nozzle assembly. A valve actuator on the valve/nozzle assembly is depressed to cause a spray of paint to be released through a nozzle at the end of the valve/nozzle assembly. The valve/nozzle assembly and attached container are moved in a desired manner about the article of clothing to create a desired painted design on the clothing. The valve actuator is then released to stop the flow of spray through the nozzle. The container is removed from the valve/nozzle assembly, and a second container of pressurized paint thinner is secured directly to the valve/nozzle assembly for cleansing the interior paint passageway in the assembly.

The present invention provides, in one form thereof, a garment painting kit comprising a disposable, single use container having an interior partially filled with paint. The container has a first attachment portion at the top portion thereof, wherein the first attachment portion has an opening therein. A closing member hermetically seals the opening, wherein the interior is pressurized to a pressure greater than atmospheric. A first fluid passageway extends from the first attachment portion downwardly into the interior of the container and hence is submerged within the paint in the interior. A valve/nozzle assembly is provided and comprises a housing including a second attachment portion that is removably attachable to the first attachment portion for securing the container to the valve/nozzle assembly. The second attachment portion includes a piercing device that is configured to pierce through the closing member upon engagement of the first attachment portion with the second attachment portion. The valve/nozzle assembly includes a second passageway extending from the first passageway to an outlet nozzle. The second passageway includes a valve disposed therein. A finger actuated trigger is operatively coupled to the valve such that upon depressing of the finger actuated trigger, the valve is opened.

DETAILED DESCRIPTION OF THE INVENTION

Figure 2:
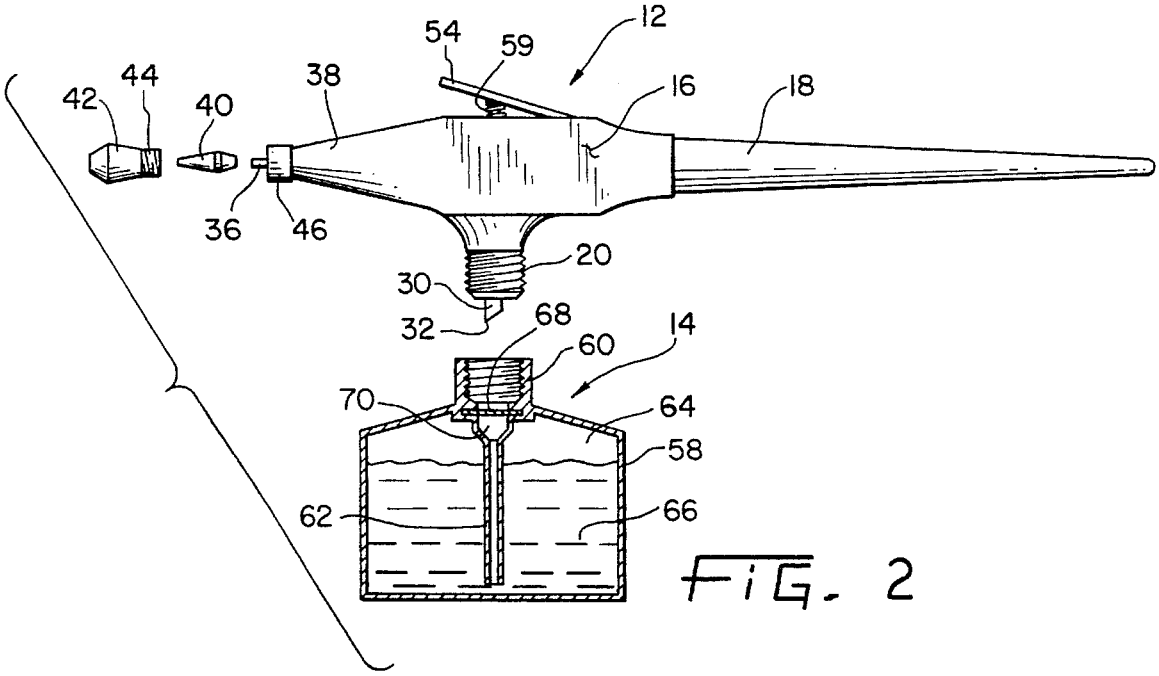
FIG. 2 is an enlarged elevation view of the airbrush painting device of FIG. 1, particularly showing a paint cartridge in section and detached from the valve/nozzle assembly.
Figure 3:
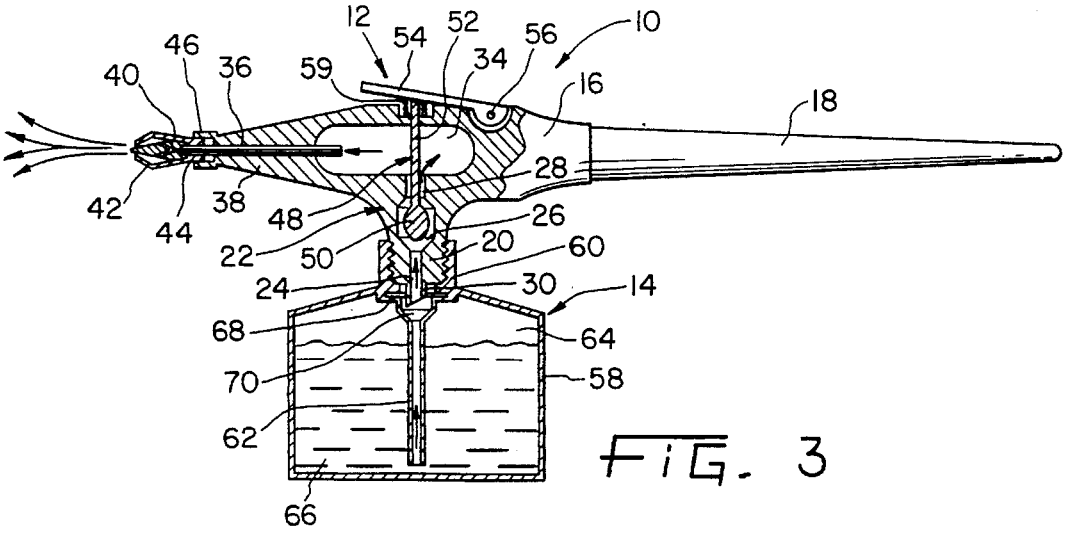
FIG. 3 is a partial sectional view of the airbrush of FIG. 2, particularly showing the cartridge attached to the valve/nozzle assembly and the trigger mechanism depressed.
Figure 4:
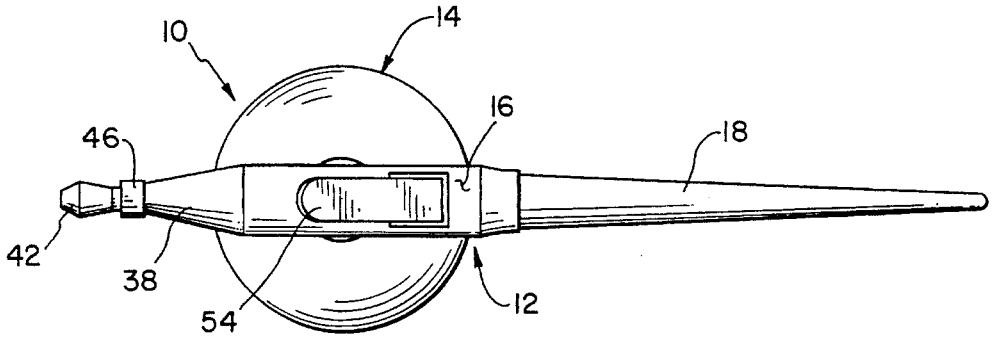
FIG. 4 is a top view of the airbrush of FIG. 3.

In an exemplary embodiment of the invention as shown in the drawings, and in particular by referring to FIGS. 2 and 3, there is shown a painting device 10 comprising a valve/nozzle assembly 12 and a paint cartridge 14. Valve/nozzle assembly 12 comprises a main body or shell 16 that houses the nozzle components of the assembly, an a handle 18 that is suitably attached to shell 16. For example, handle 18 may be threadably secured to shell 16, or may be formed integrally therewith. Shell 16 includes a fitting 20 for engagement with cartridge 14. Preferably, fitting 20 is a threaded fitting. However, other fittings are possible, such as snap-in type fittings.

As best shown in FIG. 3, a passage 22 is formed within shell 16 and includes a lower passageway 24, an enlarged intermediate passageway 26 and an upper passageway 28. Again referring to FIG. 3, a portion of lower passageway 24 is formed within a piercing member 30 that is tapered to a point 32. The remaining portion of lower passageway 24 is formed within fitting 20. Passage 22 is in flow communication with a chamber 34 formed within shell 16. A passageway 36 extends from chamber 34 through nozzle portion 38 of shell 16 and opens into a tip 40. Tip 40 is adapted to fit within a spray regulating head 42 that includes a threaded portion 44 which is threadably received into an internally threaded nut 46 secured to the end of nozzle portion 38 of shell 16. The spray regulating head 42 may be turned as desired in order to vary the thickness of the spray. For example, rotation of head 42 in a clockwise manner will cause a fine spray, useful for creating a fine line or dot. Rotation of head 42 in the counterclockwise direction will cause a wider spray useful for creating a broad pattern.

In order to release the spray, a trigger mechanism is provided and comprises a needle valve 48 having a ball portion 50 disposed in enlarged passageway 26 and a rod portion 52 extending from enlarged passageway 26 through upper passageway 28, chamber 34, and through an opening at the top of shell 16. A lever 54 is hingedly connected to shell 16 by a hinge pin 56 and is biased in the upward position by a spring 58. The top of needle valve 48 engages the bottom of lever 54 so that any movement of lever 54 will cause corresponding movement to valve 48. Although a particular valve arrangement is illustrated, other valve arrangements are possible such as gate valves, globe valves, diaphragm valves, and ball valves.

As best shown in FIG. 2, paint cartridge 14 comprises a housing 58 having an upstanding internally threaded piece 60 for reception of fitting 20. A fluid passageway 62 extends from the bottom of threaded piece 60 into the interior 64 of cartridge 14. The interior 64 is partially filled with a fluid such as paint 66. A piercable closing piece 68 is disposed within opening 70 within threaded piece 60 to hermetically seal the interior 64 of cartridge 14 from the atmosphere. Accordingly, the interior 64 of cartridge 14 can be pressurized with a gas, such as $CO_2$, after interior 64 has been partially filled with paint 66.

Figure 1:
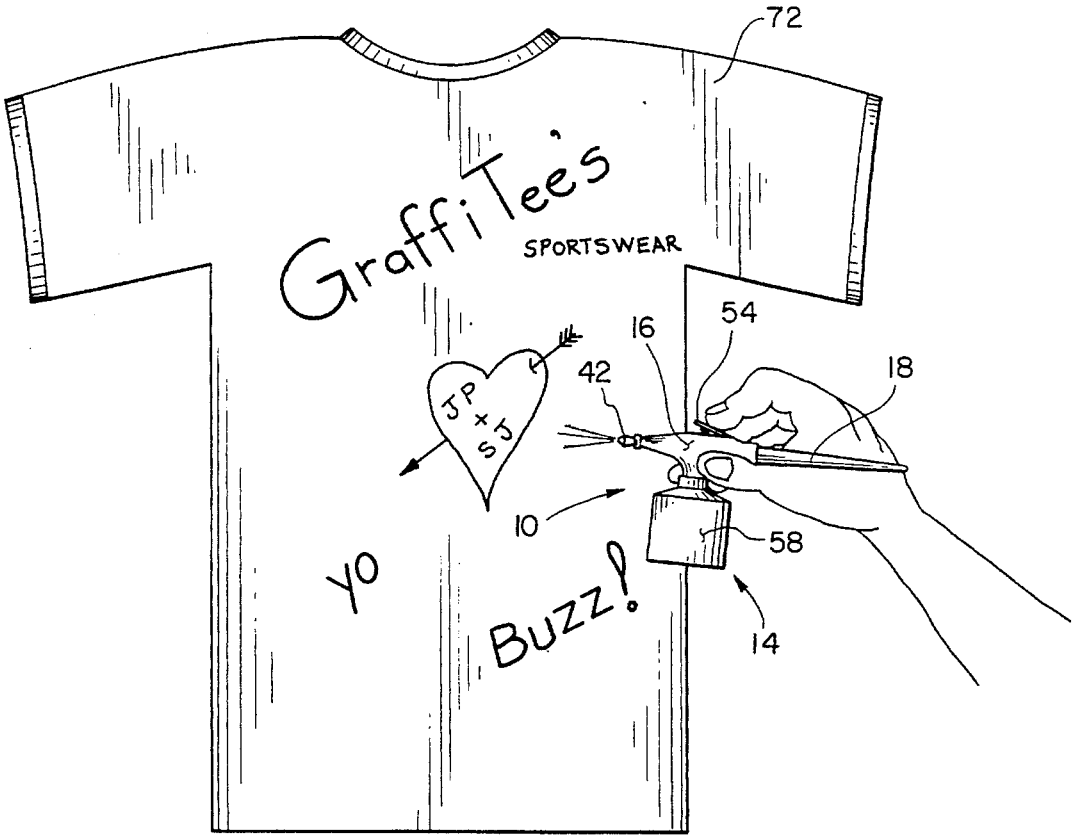
FIG. 1 is a perspective view of an exemplary painting device of the present invention particularly showing the device in use painting selected designs on a T-shirt.

When it is desired to paint a garment, such as T-shirt 72 shown in FIG. 1, cartridge 14 is grasped by the user, and piece 60 is threaded over fitting 20, thereby causing point 32 of piercing member 30 to pierce closing piece 68, as best shown in FIG. 3. Since cartridge 14 is pressurized, paint will be forced through passageway 62, opening 70, and into lower passageway 24 of valve passage 22 and then into enlarged passageway 26. However, the flow of paint will not enter upper passageway 28 because ball portion 50 sealingly covers the opening between enlarged passageway 26 and upper passageway 28.

After cartridge 14 has been threaded onto valve/nozzle assembly 12, lever 54 is depressed thereby forcing needle valve 48 downwardly which permits fluid in enlarged passageway 26 to flow into upper passageway 28 and into chamber 34. The pressurized fluid then flows through passageway 36 and into tip 40, and subsequently out through tip 40 in a spray and onto T-shirt 72. Lever 54 may be depressed and released as desired to control the spray exiting through tip 40. Any desired design may be painted onto the garment, such as specific words, symbols, or pictures. After a desired design has been sprayed, lever 54 is released and cartridge 14 is unscrewed from valve/nozzle assembly 12. Preferably, cartridge 14 is a disposable, single-use container and can be discarded upon being removed from valve/nozzle assembly 12. Then, a second cartridge containing paint thinner is threaded onto valve/nozzle assembly 12 in order to clean the internal passageways of the prior paint color. Thereafter, another cartridge of paint may be attached to valve/nozzle assembly 12 in order to apply a different color paint.

Figure 5:
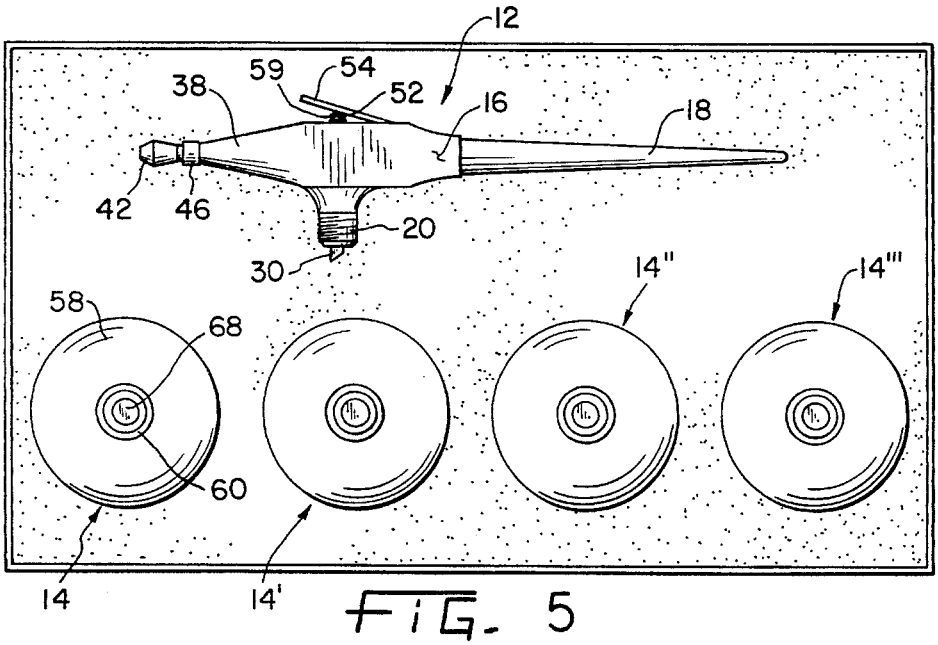
FIG. 5 is a view of an exemplary paint kit in accordance with the present invention, wherein the kit includes an a valve/nozzle assembly and four disposable, single-use paint cartridges.

Referring now to FIG. 5, an exemplary paint kit is shown and comprises a valve/nozzle assembly 12 and a plurality of paint cartridges 14, 14', 14", and 14'". Although the kit includes four cartridges, the kit may be modified to include any desired number of paint cartridges having a variety of different colors and types of paint. As mentioned earlier, it is preferred that at least one of the cartridges include a paint thinner to clean out assembly 12 between cartridges and/or after the garment has been painted.

It will be appreciated that the foregoing is presented by way of illustration only, and not by way of any limitation, and that various alternatives and modifications may be made to the illustrated embodiment without departing from the spirit and scope of the invention.

What is claimed is:

1. A method of painting a design onto an article of clothing, the method comprising the steps of:

providing a valve/nozzle assembly comprising an elongated main body, an elongated handle attached to an end of the main body, a spray regulating head attached opposite the elongated handle, and a container attaching portion having a piercing means, the main body including a passageway extending from the container attaching portion to an outlet nozzle opening located opposite the elongated handle, a passageway including a valve disposed therein, the valve being operatively coupled to a finger actuated trigger for selectively actuating the valve, wherein the trigger is located opposite the container attaching portion, the spray regulating head including a threaded portion threaded into an internal nut secured to the end of the main body opposite elongated handle;

securing a container of pressurized paint directly to the container attaching portion and operatively connecting the valve/nozzle assembly with the container of pressurized paint using the piercing means, thereby causing the paint to flow into the passageway of the main body, wherein said container is attached to the main body in such a manner as to prevent noticeable upward recoil of main body upon paint being delivered through said outlet nozzle opening;

grasping the main body of the valve/nozzle assembly between a thumb and a forefinger, thereby causing the elongated handle to be embraced against a hand of the user;

depressing the trigger on the valve/nozzle assembly with the forefinger to cause a fine spray of paint to be released through the nozzle;

moving the valve/nozzle assembly and attached container in a controlled manner about an article of clothing to create a painted design on the clothing;

rotating the spray regulating head in one direction to narrow the thickness of the spray and in the opposite direction to widen the thickness of the spray;

releasing the trigger to stop the flow of spray through the nozzle; and removing the container from the main body of the valve/nozzle assembly.

2. The method of claim 1, including the steps of:

securing a second container of pressured paint thinner directly to the main body of the valve/nozzle assembly;

depressing the trigger on the valve/nozzle assembly to cause a spray of paint thinner to be released through the nozzle of the valve/nozzle assembly, thereby cleansing the main body passageway;

and removing the second container from the valve/nozzle assembly.

3. The method of claim 2, including the steps of:

securing a third container of pressurized paint directly to the valve/nozzle assembly and operatively connecting the valve/nozzle assembly with the container of pressurized paint using the piercing means;

depressing the trigger on the valve/nozzle assembly with the forefinger to cause a fine spray of paint to be released through the nozzle;

moving the valve/nozzle assembly and attached container in a controlled manner about the article of clothing to create a second painted design on the clothing;

rotating the spray regulating head in one direction to narrow the thickness of the spray and in the opposite direction to widen the thickness of the spray;

releasing the trigger to stop the flow of spray through the nozzle; and removing the third container from the valve/nozzle assembly.

* * * * *